US006932724B2

(12) United States Patent
Socci

(10) Patent No.: US 6,932,724 B2
(45) Date of Patent: Aug. 23, 2005

(54) DEVICE FOR BASEBALL BATTERS

(76) Inventor: Roger D. Socci, 11720 Newbridge Ct., Reston, VA (US) 20191

( * ) Notice: Subject to any disclaimer, the term of this patent is extended or adjusted under 35 U.S.C. 154(b) by 0 days.

(21) Appl. No.: 10/689,724

(22) Filed: Oct. 22, 2003

(65) Prior Publication Data

US 2004/0138013 A1 Jul. 15, 2004

Related U.S. Application Data

(60) Provisional application No. 60/420,340, filed on Oct. 23, 2002.

(51) Int. Cl.[7] ..... A63B 69/00
(52) U.S. Cl. ..... 473/458; 473/422
(58) Field of Search ..... 473/422, 450, 473/458, 464, 451, 207, 212, 215, 216, 227, 276, 277

(56) References Cited

U.S. PATENT DOCUMENTS 475,432 A * 5/1892 Blades ..... 473/415
1,591,523 A * 7/1926 Fuller ..... 473/215
3,200,536 A * 8/1965 Petitto, Sr. ..... 446/28
4,688,800 A * 8/1987 Lopez ..... 473/215
4,883,276 A * 11/1989 Brown ..... 473/215
5,375,836 A * 12/1994 Kiser ..... 473/458
5,390,929 A * 2/1995 Todaro ..... 473/215
5,643,097 A * 7/1997 Bechler et al. ..... 473/215
2004/0076939 A1 * 4/2004 Socci ..... 434/258

* cited by examiner

*Primary Examiner*—Mitra Aryanpour
(74) *Attorney, Agent, or Firm*—Armstrong, Kratz, Quintos, Hanson & Brooks, LLP

(57) ABSTRACT

A baseball training device for use in improving batting skills, the device comprising an elongated member of at least a length to extend about the torso of a wearer and form a loop, and a target member slidably secured to the elongated member and adapted to engage an upper arm of a wearer upon proper movement of the arm of the wearer during a batting swing.

6 Claims, 2 Drawing Sheets

DEVICE FOR BASEBALL BATTERS

This application claims benefit of U.S. Provisional application Ser. No. 60/420,340 filed Oct. 23, 2002.

The present invention relates generally to devices for assisting persons to learn sports skills and, more particularly, to devices for assisting persons to learn or improve batting skills for playing the game of baseball.

In hitting a baseball, a baseball batter should not extend his arms until contact with ball or raise his front arm during the swing. Rather, the batter should always strive to stay "inside" the baseball while in the process of swinging. Staying "inside" means that the hands of the batter must never be on the same line with the ball or beyond the line of the ball.

If the batter does not stay inside the ball with his hands, he will prematurely extend his elbow and arms while in the act of swinging. This action will cause bat panning or bat sweeping which results in a loss of power and an ineffectual swing. Either of these two occurrences cause a batter to go around the ball instead of directly to the ball.

Additionally, in conducting a proper swing, the batter should carry his front arm parallel or level with the ground and not raise the front arm when swinging. When a batter does raise his front arm during the act of swinging, the undesirable action is known as "chicken winging," which will improperly raise the front shoulder, drop the back shoulder and cause the batter to lower the bat head below his hands resulting in an uppercut swing. This type of swing will also minimize the ability of the batter to swing on a level plane.

SUMMARY OF THE INVENTION

It therefore is a feature of the subject invention to provide a device for assisting persons to learn and/or improve batting skills for playing the game of baseball.

It also is a feature of the subject invention to provide a device for assisting persons to keep "inside the ball" when batting in the game of baseball.

It further is a feature of the subject invention to provide a device for assisting persons to avoid "chicken winging" when batting in the game of baseball.

Briefly, the present invention comprehends in its broader aspects a baseball training device for use in improving batting skills, the device comprising an elongated member of at least a length to extend about the torso of a wearer and form a loop, and a target member slidably secured to the elongated member and adapted to engage an upper arm of a wearer upon proper movement of the arm of the wearer during a batting swing.

The present invention further comprehends a baseball training device for use in improving batting skills, the device comprising an elongated member of at least a length to extend about the torso of a wearer and having two distil ends, a fastener for engaging the two distal ends of the elongated member so as to form a loop, and a target member slidably secured to the elongated member, and adapted to engage an upper arm of a wearer upon proper movement of the arm of the wearer during a batting swing.

Further features and advantages of the present invention will become more fully apparent from a detailed consideration of the arrangement and construction of the constituent parts as set forth in the following description taken together with the accompanying drawings.

DETAILED DESCRIPTION OF THE PREFERRED EMBODIMENTS

Figure 1:
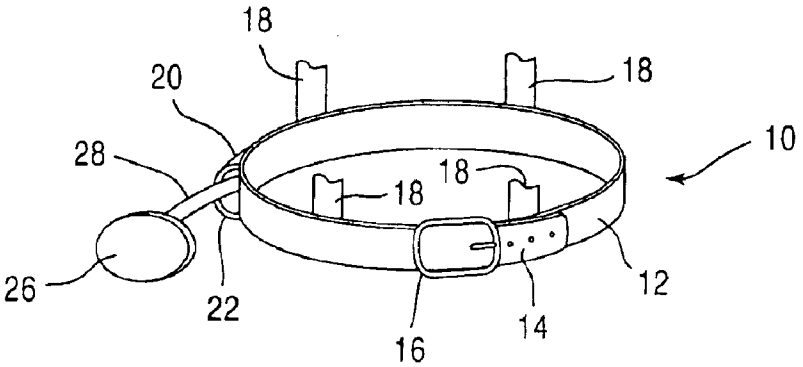
FIG. 1 is a perspective view of an embodiment of the training device in accordance with the present invention.

As shown in FIG. 1 of the drawings, the training device 10 in accordance with the present invention comprises an elongated member 12 of at least a length to extend about the torso of a wearer at some point above the waist. Elongated member 12 has two distil ends 14, and a fastener 16 for engaging the two distal ends of the elongated member so as to form a loop. Fastener 16 may be a buckle as shown or alternatively a clasp, snap, hook-and-loop or other type of conventional fastener. Alternatively, elongated member 12 may be at least partially formed of a stretch type material such that fastener 16 is not necessary, the training device merely being slipped over the torso of the wearer and maintained in that position by the stretchable nature of the stretch type material.

In use, elongated member 12 is slipped on or snugly cinched about the wearer such that elongated member is not free to move relative to the torso of the wearer. If desired, shoulder straps 18 may be attached to elongated member 12 to form a suspender-type arrangement for further supporting the member (see FIGS. 4–6 for a more complete illustration of the shoulder straps). These shoulder straps 18 extend from the elongated member 12 at the front of the wearer, over the shoulder of the wearer, and to the elongated member at the back of the wearer. One shoulder strap 18 may be sufficient, but two straps may be preferable.

Figure 2:
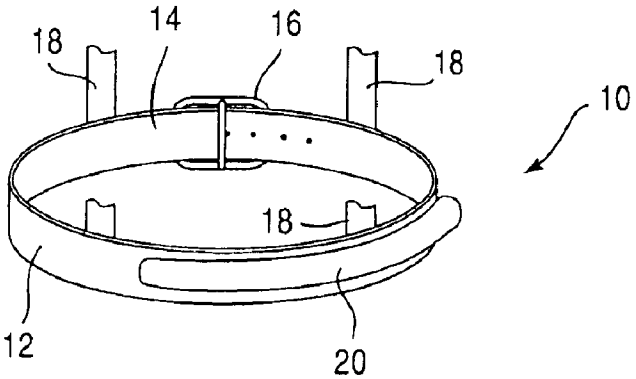
FIG. 2 illustrates in a perspective view of the back of the embodiment of the training device according to the invention as shown in FIG. 1.

Training device 10 of this embodiment further includes an elongated pocket or sheath 20 on the back portion of the elongated member 12 as is shown in FIG. 2. Pocket 20 defines a generally open cylindrical space having an opening 22. The pocket 20 on elongated member 12 is adapted to positioned on the back of wearer as is shown in FIG. 6.

Figure 3:
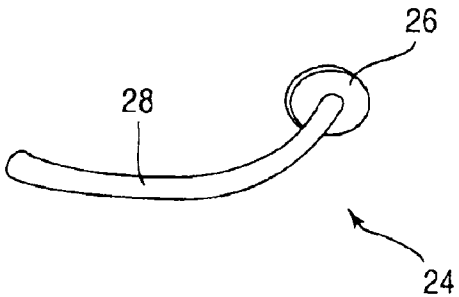
FIG. 3 illustrates in a perspective view a target member forming a portion of the embodiment of the training device according to the invention as shown in FIG. 1.

Training device 10 further includes target member 24 as shown in FIG. 3. Target member 24 comprises a circular target 26 in the form of a disc or the like, the target being affixed to an elongated stem 28 having a slight curvature along its length so as to conform to the shape of pocket 20 when elongated member 12 is worn about the torso of a wearer.

Target 26 of target member 24 is adapted to project a short distance away from the torso of the wearer. Because stem 28 loosely fits in pocket 20, target member 24 is able to slide relative to elongated member 12. Target member 24 may be yieldingly biased within pocket 20 by a spring or the like.

Figure 6:
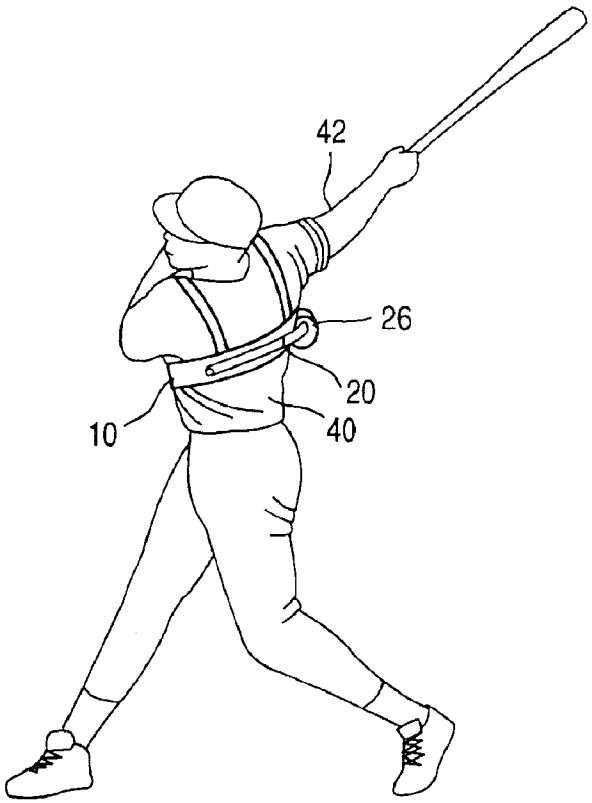
FIG. 6 illustrates in another perspective view a baseball player wearing the embodiment of the training device of the invention as shown in FIG. 4.
Figure 5:
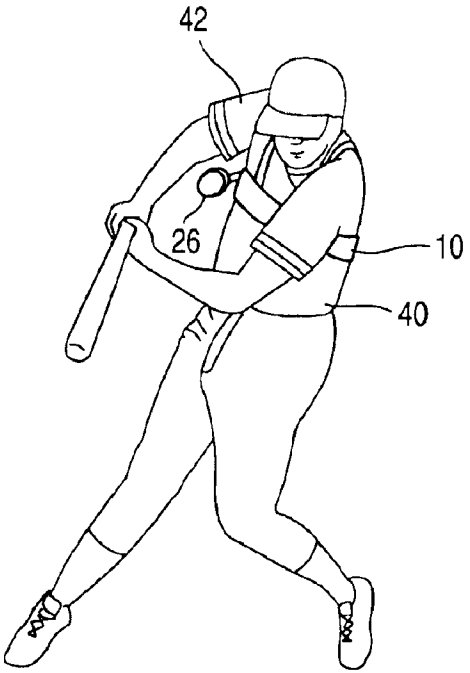
FIG. 5 illustrates in another perspective view a baseball player wearing the embodiment of the training device of the invention as shown in FIG. 4.
Figure 4:
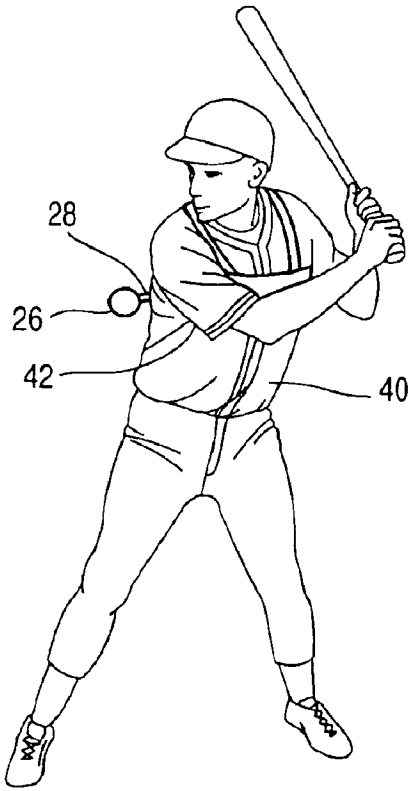
FIG. 4 is a perspective view of a baseball player wearing an embodiment of the training device in accordance with the present invention.

One use of training device 10 is illustrated in FIGS. 4 through 6 where the device is being worn by a batter 40. At the initial position of the batting swing as shown in FIG. 4, stem 28 with attached target 26 extends from pocket 20 on elongated member 12 such that the target is at a position behind leading arm 42 of batter 40. If, during a batting swing, batter 40 correctly positions his arms, the upper portion of leading arm 42 will strike target 26 and cause stem 28 to be forced into pocket 20. That is, if batter 40 keeps his front arm 42 level across his chest and parallel to the ground during the swing, target 26 will be engaged by the front arm of the batter. At the completion of the swing as shown in FIG. 6, it will be evident to batter 40 that the swing was conducted properly as stem 28 will have been forced into pocket 20 and target 26 will be adjacent to opening 22 of the pocket.

If, on the other hand, batter 40 improperly raises his front shoulder and/or extends the arms prematurely during the swing such as shown in FIG. 5, the upper portion of leading arm 42 of the batter will not strike target 26 and stem 28 will not be forced into pocket 20. That is, if the batter extends his arms too early (pans or sweeps), the front elbow or arm of the batter 40 will not be able to engage target 26. At the completion of the swing, the improper swing motion with be apparent to batter 40 as no movement of target 26 has occurred.

Thus, with the device of the present invention, the batter can ascertain that he indeed kept his arms in the proper position during the swing. Therefore, the batter can determine that he either did not stay inside the ball or raised his front arm while in the act of swinging and thereby "chicken winged" during the swing.

It is contemplated that the training devices in accordance with the present invention further may include a signal device (not shown) in connection with the target member and/or the elongated member to provide a positive indication in the form of a signal that a proper swing has occurred. The signal device may generate an audible sound and/or a visual indication. The signal can be generated by mechanical and/or electrical devices such clickers, buzzers, lights and the like.

Training devices in accordance with the invention may be made of any suitable material such as cloth, rubber or polymeric materials.

While there has been shown and described what are considered to be preferred embodiments of the present invention, it will be apparent to those skilled in the art to which the invention pertains that various changes and modifications may be made therein without departing from the subject invention.

It is claimed:

1. A baseball training device for use in improving batting skills, the device comprising an elongated member of at least a length to extend about the torso of a wearer and form a loop, a pocket on a surface of the elongated member and adapted to be positioned on the back of the wearer, and a target member comprising an elongated stem slidably received in the pocket and a target affixed to an end of the elongated stem exterior of the pocket, the target adapted to engage an upper portion of a front arm of a wearer upon proper movement of the arm of the wearer at an end of a batting swing and thereby cause the target stem to slide further into the pocket.

2. A baseball training device according to claim 1, wherein the elongated stem has a slight curvature along its length so as to conform to the shape of the pocket.

3. A baseball training device according to claim 1, wherein further including at least one shoulder strap attached to the elongated member.

4. A baseball training device for use in improving batting skills, the device comprising an elongated member of at least a length to extend about the torso of a wearer and having two distil ends, a fastener for engaging the two distal ends of the elongated member so as to form a loop, a pocket on a surface of the elongated member and adapted to be positioned on the back of the wearer, and a target member comprising an elongated stem slidably received in the pocket and a target affixed to an end of the elongated stem exterior of the pocket, the target adapted to engage an upper arm of a wearer upon proper movement of the arm of the wearer at an end of a batting swing and thereby cause the target stem to slide further into the pocket.

5. A baseball training device according to claim 4, wherein the elongated stem has a slight curvature along its length so as to conform to the shape of the pocket.

6. A baseball training device according to claim 4, wherein further including at least one shoulder strap attached to the elongated member.

* * * * *